United States Patent [19]

Gathright

[11] 4,352,480

[45] Oct. 5, 1982

[54] (PF-2) DOUBLE GUITAR STAND

[76] Inventor: Wayne R. Gathright, P.O. Box 3829, Austin, Tex. 78764

[21] Appl. No.: 230,325

[22] Filed: Feb. 2, 1981

[51] Int. Cl.[3] ..... G10G 5/00; A45C 11/00; B65D 21/02; A47G 19/00

[52] U.S. Cl. ..... 248/443; 206/314; 220/23.4; 84/327; 248/460; 248/461

[58] Field of Search ..... 206/14, 314, 45.14; 248/443, 460, 461; 84/327, 453; 220/23.4

[56] References Cited

U.S. PATENT DOCUMENTS

| | | | |
|---|---|---|---|
| 1,208,622 | 12/1916 | Muller | 248/461 |
| 1,986,703 | 1/1935 | Baker | 206/14 |
| 3,799,488 | 3/1974 | Sena | 248/460 |

*Primary Examiner*—William T. Dixson, Jr.

[57] ABSTRACT

A stand for supporting a plurality of guitars; including a collapsible frame, which, when folded up, fits into a carrying case; the frame being made of a plurality of telescopic posts, fitted with rest units and yokes, that support the guitars, and braces for holding the posts upright, and both the posts and braces being pivotable into a folded-away position inside the case.

3 Claims, 4 Drawing Figures

10
10A
11
12
13
14
15
16
17
18
19
20
21
22
23
24
25
27
28
29
30
31
32
33
34
35
36
37
38
39
40

(PF-2) DOUBLE GUITAR STAND

This invention relates generally to racks, upon which musical instruments may be stored, when not in use.

It is well known that, when a performing guitar musician wishes to change guitars, he is often obliged to place the unused instrument upon a chair, a low stand or other place, which requires him to stoop over, in order to put it down or pick it up. The unused instrument, usually rested in a horizontal position, takes a moment of time, when picked up, to be swung into an operative position, which lost time may interfere with his musical performance. This situation is, accordingly, in need of an improvement.

Accordingly, it is a principal object of the present invention to provide a guitar stand, upon which a plurality of guitars may be rested, when not in use; the guitars being placed in a vertically inclined position, and at an elevation which requires no stooping over, for a standing performer to reach.

Another object is to provide a double guitar stand, which is telescopic and foldable, so as to fit readily inside a travel case, for convenient transportation by a traveling performer.

Still a further object is to provide a double guitar stand, to which additional stand units readily connect, in order to support additional guitars.

Other objects of the present invention are to provide a double guitar stand, which is simple in design, inexpensive to manufacture, rugged in construction, easy to use and efficient in operation.

These, and other objects, will be readily evident, upon a study of the following specification, and the accompanying drawing, wherein.

Figures 1, 2, 3, 4:
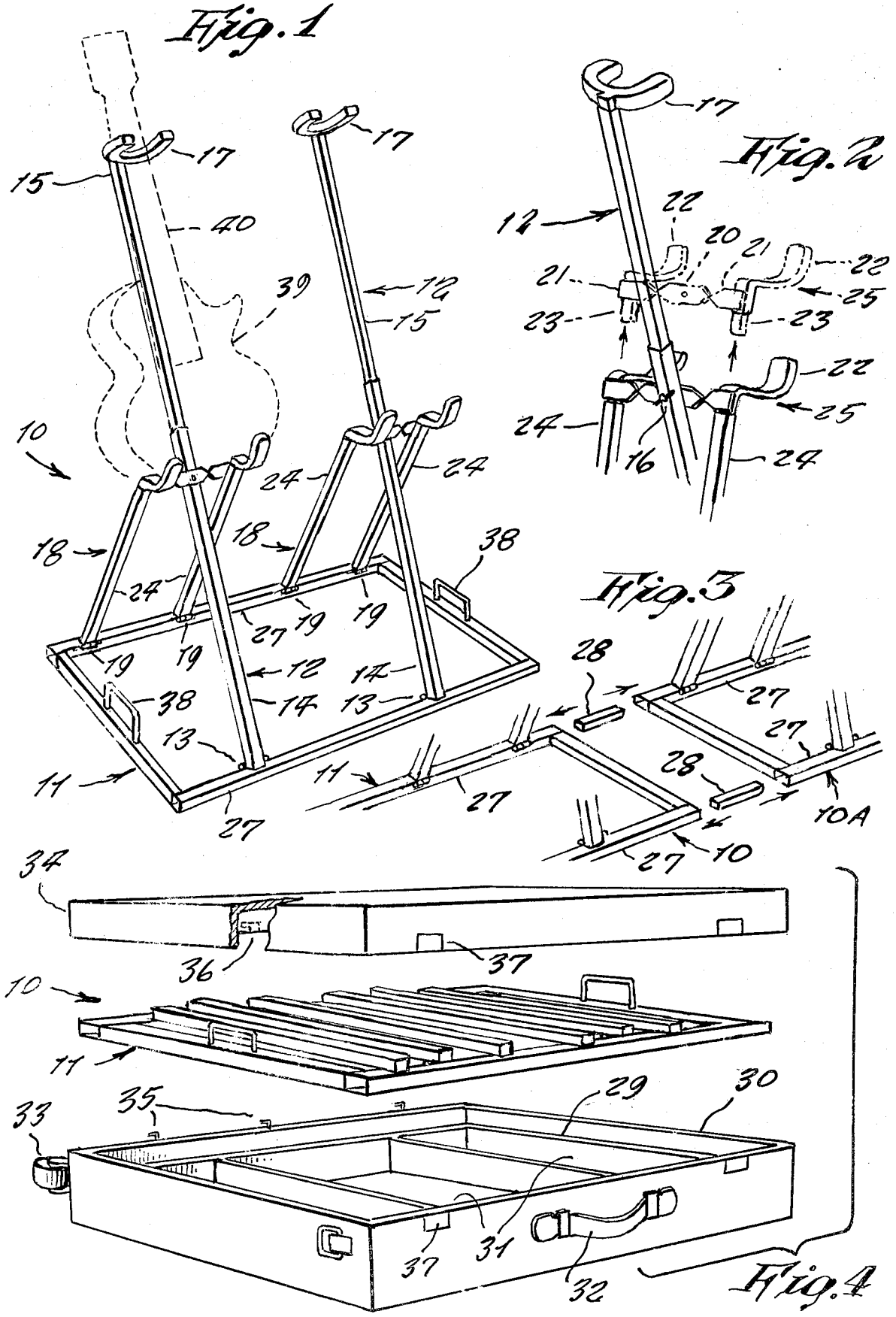
FIG. 1 is a front perspective view of a double guitar stand, shown in an erected position for use.
FIG. 2 is a fragmentary rear perspective view thereof, so as to illustrate the construction thereof.
FIG. 3 is a fragmentary top perspective view of the frame base, and showing means whereby two stands are readily attached together.
FIG. 4 is an exploded perspective view of a carrying case with its cover, and showing the guitar stand in a collapsed position for storage therein.

Referring now to the drawing in greater detail, the reference numeral 10 represents a double guitar stand, according to the present invention, wherein the same is made from cross-sectionally square aluminum tubing, and which includes a rectangular base frame 11, measuring twenty-four by thirty-six inches.

A pair of spaced-apart, telescopic posts 12 are pivotally attached, by means of hinges 13, to one longitudinal side of the base frame; each post comprising an outer, lower tube 14, inside which an inner, upper tube 15 is slidable, and secured in an elevated position, by means of a winged set screw 16 therebeneath, inserted transversely through tube 14.

A yoke 17, padded with a soft material, includes a stem, that fits inside the upper end of each post.

A pair of braces 18, pivotally attached to an opposite longitudinal side of the base frame, by means of hinges 19, are provided so as to hold the posts in an upwardly standing position.

The set screw 16, inserted transversely through the tube 14, secures into a plate 20, which, at each opposite side end, pivotally supports a plate 21, affixed to a padded, curved rest 22, which is integral with a stem 23, that slides into the upper end of each of the two tubes 24, that form the brace. The rests, together with the plate 20, form an integral rest unit 25.

As indicated at 26, the opposite ends of the base frame longitudinal side tubes 27 are left open, in order to receive pins 28, to which other stands may likewise be fitted, in order that a singular assembly of several guitar stands may thus be achieved. Such additional guitar stands 10A may either be of double guitar type, as described or they may be made for supporting only a single guitar, so that the assembly thus serves to hold three guitars, as preferred.

The above-described double guitar stand, in a fully collapsed position, and with the yoke and rest unit removed, as shown in FIG. 4, is then placeable upon a ledge 29, inside a carrying case 30, so as to be conveniently transportable.

The case includes compartments 31, in which the removed yokes, rest units and other accessories may be stored. The case includes a carrying handle 32, and caster wheels 33 underneath, for travel on a floor or other flat surface. The case is closable by a removable cover 34, pivotably attachable to the case, by pins 35 being receivable in corresponding openings 36 of the cover, the cover then being locked by conventional luggage latches 37.

In operative use of the double guitar stand, the cover 34 may first be placed upon the floor, with its inner side facing upwardly, and the base frame of the stand then fitted therein. A U-shaped handle 38, on each opposite end of the base frame, permits easy removal of the stand from within either the case or the cover. To erect the stand, the extended posts and braces are pivoted upwardly, and the rest units and yokes fitted thereto. A guitar 39 is then placeable upon the rest unit, and the guitar neck 40 fitted in the yoke, for support therein.

While various changes may be made in the detail construction, it is understood that such changes will be within the spirit and scope of the present invention, as is defined by the appended claims.

What is claimed as new, is:

1. A double guitar stand, comprising, in combination, a rectangular base frame, a plurality of extensible telescopic posts and braces hinged on said base frame, a rest unit and yoke on each said post for supporting a guitar thereupon wherein a plurality of said stands can be attached together by means of pins fitted between the said frame thereof.

2. The combination as set forth in claim 1 wherein said telescopic posts are slidably movable and secured by a tightening device, such as a set screw, to a position that accomodates various body thicknesses and neck lengths of guitars.

3. The combination as set forth in claim 2 wherein each support post is of sufficient length that when said stand is assembled, the guitar is supported at an elevation which allows a standing person to remove, replace, or repair the guitar without stooping over.

* * * * *